United States Patent [19]

Hand et al.

[11] 4,052,015

[45] Oct. 4, 1977

[54] FILAMENT WINDING APPARATUS

[75] Inventors: Ronnie D. Hand; Robert N. Chappelear, both of Anderson, S.C.; Dale R. Mueller, Toledo, Ohio

[73] Assignee: Owens-Corning Fiberglas Corporation, Toledo, Ohio

[21] Appl. No.: 646,739

[22] Filed: Jan. 5, 1976

[51] Int. Cl.[2] ..... B65H 54/02; B65H 54/28; B65H 79/00

[52] U.S. Cl. ..... 242/18 G; 242/18 A; 242/43 R

[58] Field of Search ..... 242/18 A, 25 A, 18 G, 242/43 R

[56] References Cited

U.S. PATENT DOCUMENTS

| | | | |
|---|---|---|---|
| 2,772,054 | 11/1956 | Herele et al. | 242/18 A |
| 2,978,194 | 4/1961 | Lloyd et al. | 242/25 A |
| 3,408,012 | 10/1968 | Smith et al. | 242/18 G |

*Primary Examiner*—Stanley N. Gilreath
*Attorney, Agent, or Firm*—John W. Overman; Paul J. Rose

[57] ABSTRACT

The winding apparatus includes a turret periodically indexible through half a revolution by a worm and worm gear mechanism and having a pair of winding collets rotatably mounted thereon and driven respectively by a pair of stationarily mounted variable-speed electric motors which are also selectively drivingly connected to a strand oscillator shaft respectively by a pair of one-way clutches mounted on a common shaft.

3 Claims, 12 Drawing Figures

FILAMENT WINDING APPARATUS

This invention relates generally to filament or strand winding apparatus and more particularly to apparatus suitable for collecting and winding glass fibers or filaments being formed continuously in a bushing in the floor of a forehearth of a furance for melting glass or glass forming material. The apparatus includes a rotatably driven strand oscillator and a pair of winding collets rotatably mounted on a turret and movable thereby interchangeably between a winding or package forming position adjacent the strand oscillator and a strand package unloading position on the opposite side of the winding position from the strand oscillator upon indexing of the turret through half a revolution. The winding collets are driven respectively by a pair of stationarily mounted variable-speed electric motors. The speed of the collet at the winding station is progressively reduced as the diameter of the strand package being would increases, in order to maintain the diameter of the filaments being formed substantially constant. For a proper winding pattern repeatable in package after package of wound strand, the collet in the winding position must be as nearly as possible in the same spatial relationship to the strand oscillator after each indexing thereof to the winding position, and the rotational speed of the strand oscillator shaft must be in a constant ratio to the speed of the collet in the winding position and thus vary directly therewith as the collet speed is reduced with increasing strand package diameter. These requirements have not been met satisfactorily in the automatic winders of the prior art.

An object of the invention is to provide filament winding apparatus having a rotatably driven strand oscillator and a pair of winding collets rotatably mounted on a turret indexible to move the collets interchangeably between a winding or package forming position and a package unloading position, wherein improved means are provided to insure substantially the same spatial relationship between the collet in the winding position at a particular time and the strand oscillator after each indexing operation of the turret and to insure a constant speed ratio between the rotational speed of the strand oscillator shaft and the rotational speed of the collet in the winding position, both before and after indexing of the collets and throughout progressive speed changes of the collet in the winding position.

Other objects and advantages will become apparent when the following specification is considered along with the accompanying drawings in which:

FIG. 3 is a fragmentary plan view of the filament winding apparatus of FIG. 1;

Figure 1:
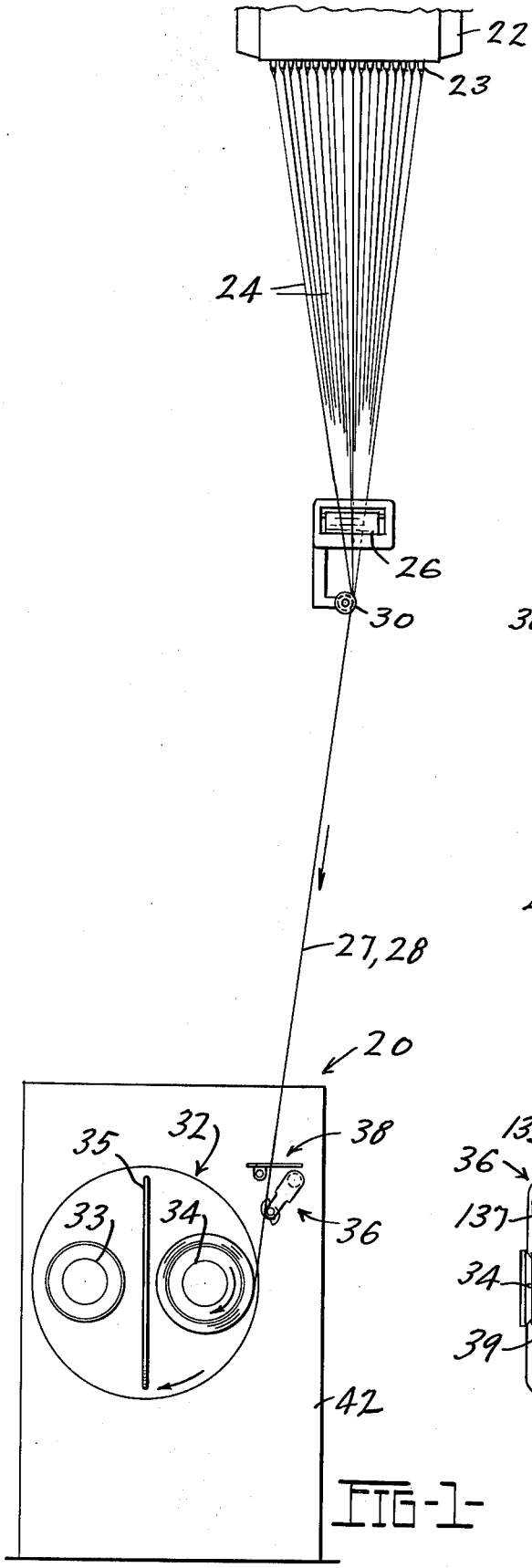
FIG. 1 is a respresentative front view of one embodiment of a filament winding apparatus constructed in accordance with the invention, along with a representation of a glass melting furance bushing for forming continuous glass filaments and a sizing applicator and guide means for the filaments.
Figure 2:
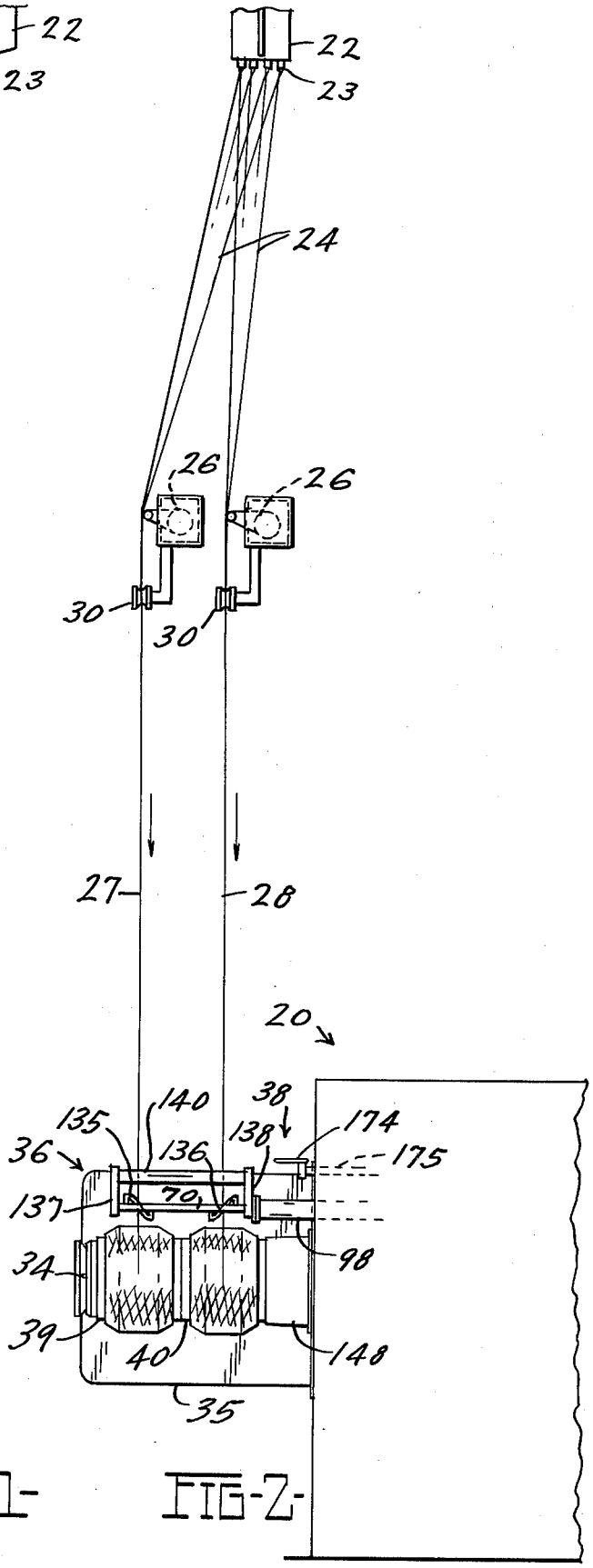
FIG. 2 is a side view of the apparatus of FIG. 1.

With respect to the drawings, FIGS. 1-4 show a filament winding apparatus 20 constructed in accordance with the invention. FIGS. 1 and 2 also fragmentarily show a bushing 22 in the floor (not shown) of the forehearth of a furnace for melting glass or glass forming materials. The bushing 22 is provided with a plurality of tips 23 each having a small passageway through which molten glass flows to form a glass filament 24. In the embodiment shown, two groups of filaments 24 are passed respectively over a pair of sizing applicator belts 26 and are gathered respectively into a pair of strands 27 and 28 by a pair of guide pulleys 30. The strands 27 and 28 are wound into packages on the winding apparatus 20.

The apparatus 20 includes a turret 32 periodically indexible through half a turn and having a pair of winding collets 33 and 34 rotatably mounted thereon and separated by a shield 35. In FIG. 1, the collet 33 is in a package unloading position and the collet 34 is in a winding or package forming position. The collets are interchangeably moved upon the indexing of the turret clockwise as viewed in FIG. 1 through half a revolution. A strand oscillator 36 is provided adjacent the collet in the winding position, and strand hold-off means 38 is provided adjacent the strand oscillator.

The strands 27 and 28 are wound respectively on a pair of paper sleeves 39 and 40 shown on the collet 34. When the turret 32 is indexed to move the collet 34 into the package unloading position, the sleeves 39 and 40 with strand packages would thereon are removed from the collet and replaced by a pair of empty paper sleeves.

The collets 33 and 34, the shield 35, the strand oscillator 36, and the strand hold-off means 38 extend forwardly of a front panel 42 of the winding apparatus 20. The operating mechanisms for the turret 32, collets 33 and 34, strand oscillator 36, and strand hold-off means 38 are disposed rearwardly of the front panel 42 and shown in FIGS. 3 and 4.

The collets 33 and 34 are driven respectively by a pair of variable-speed electric motors 43 and 44 (FIG. 4) adjustably mounted on suitable framework. The motor 44 drives a grooved timing pulley 45 connected by a toothed gear belt 46 to a grooved timing pulley 47 keyed one end portion of a shaft 48 best shown in FIG. 5. The shaft 48 drives a grooved timing pulley 49 keyed thereto at an opposite end portion from the pulley 47 and connected by a toothed gear belt 50 to a grooved timing pulley 51 keyed to an inner end portion of a shaft 52 of the collet 34. The motor 43 drives a grooved timing pulley 55 connected by a toothed gear belt 56 to a grooved timing pulley 57 secured to one end portion of a hollow shaft 58 shorter than and mounted concentrically of the shaft 48. The shaft 58 drives a grooved timing pulley 59 secured thereto at an opposite end portion from the pulley 57 and connected by a toothed gear belt 60 to a grooved timing pulley 61 keyed to an inner end portion of a shaft 62 of the collet 33.

A suitably supported housing 64 rotatably supports the hollow shaft 58 in a pair of ball bearings 65 and 66, and the shaft 58 rotatably supports the shaft 48 in a pair of ball bearings 67 and 68.

Figure 6:
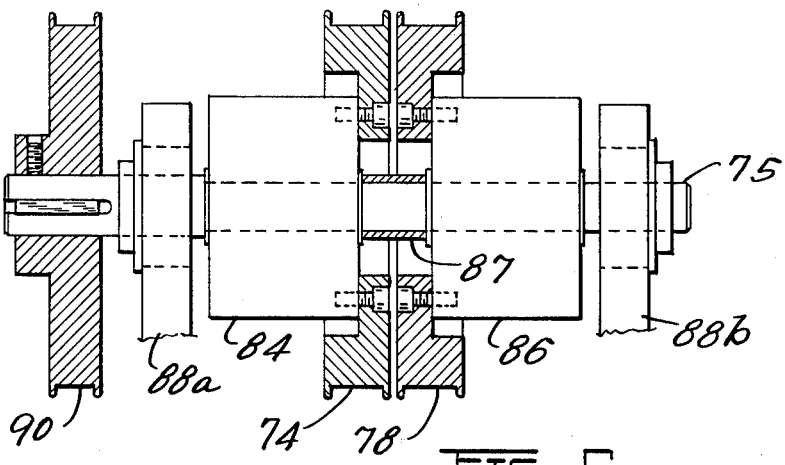
FIG. 6 is an enlarged fragmentary vertical partially sectional view of a pulley, clutch, and drive shaft assembly of the winding apparatus of FIG. 1 taken generally along the line 6—6 of FIG. 3.
Figure 7:
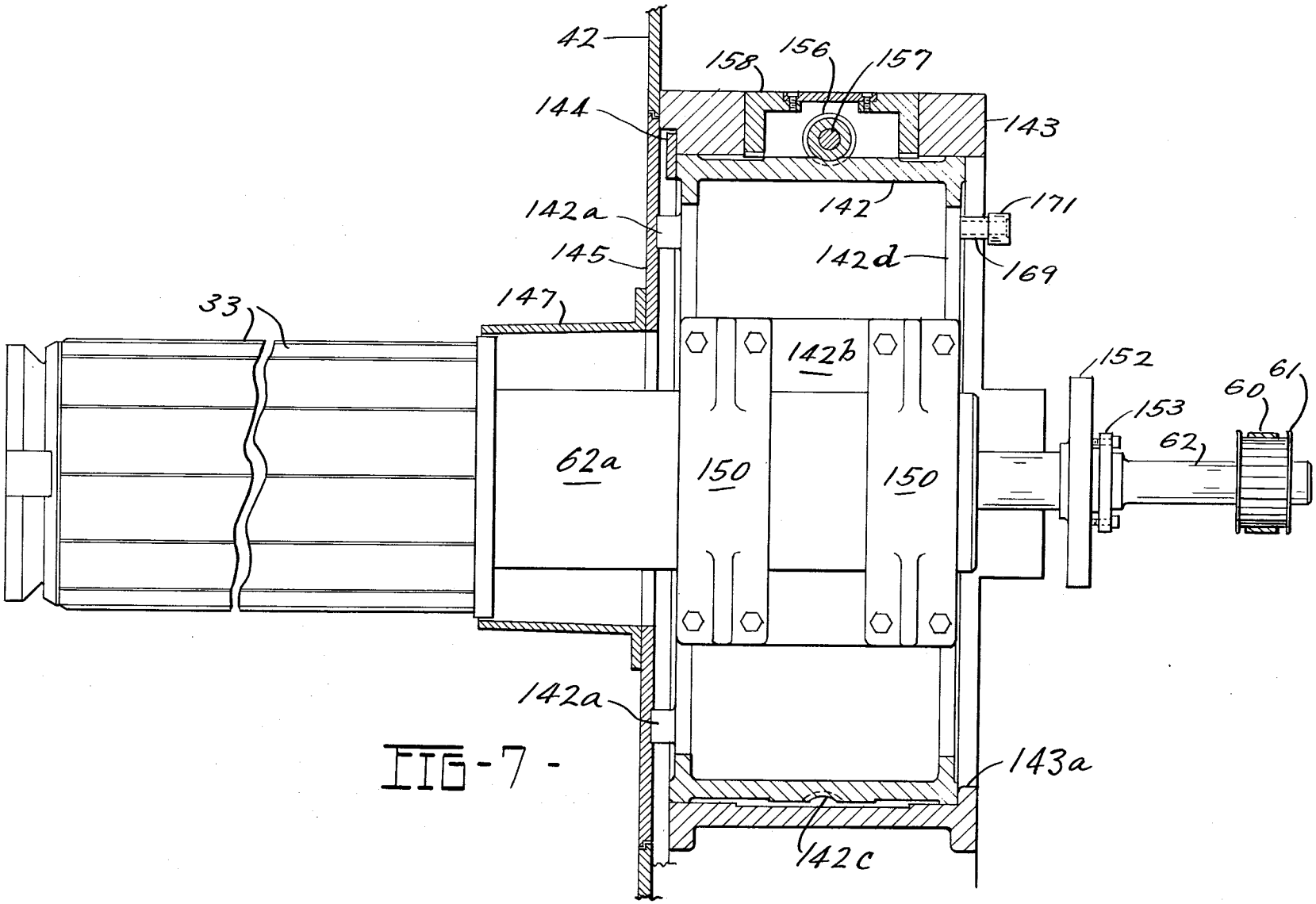

A shaft 70 (FIGS. 2, 3, 4, 8, 9, and 10) of the strand oscillator 36 is rotatably driven selectively by the motors 43 and 44. The shaft 48 drives a grooved timing pulley 72 keyed thereto adjacent the pulley 47 and connected by a double gear belt 73, toothed on both inner and outer surfaces thereof, to a grooved timing pulley 74 (FIGS. 3 and 6) on a shaft 75. The shaft 58 drives a grooved timing pulley 76 secured thereto adjacent the pulley 57 and connected by a double gear belt 77 to a grooved timing pulley 78 on the shaft 75. The belts 73 and 77 are driven on their outer surfaces, passing completely beneath the pulleys 72 and 76 in both directions and extending respectively around a pair of idler grooved timing pulleys 79 and 80 on a stub shaft 81 mounted on an adjustable bracket 82 (FIG. 3).

Figure 4:
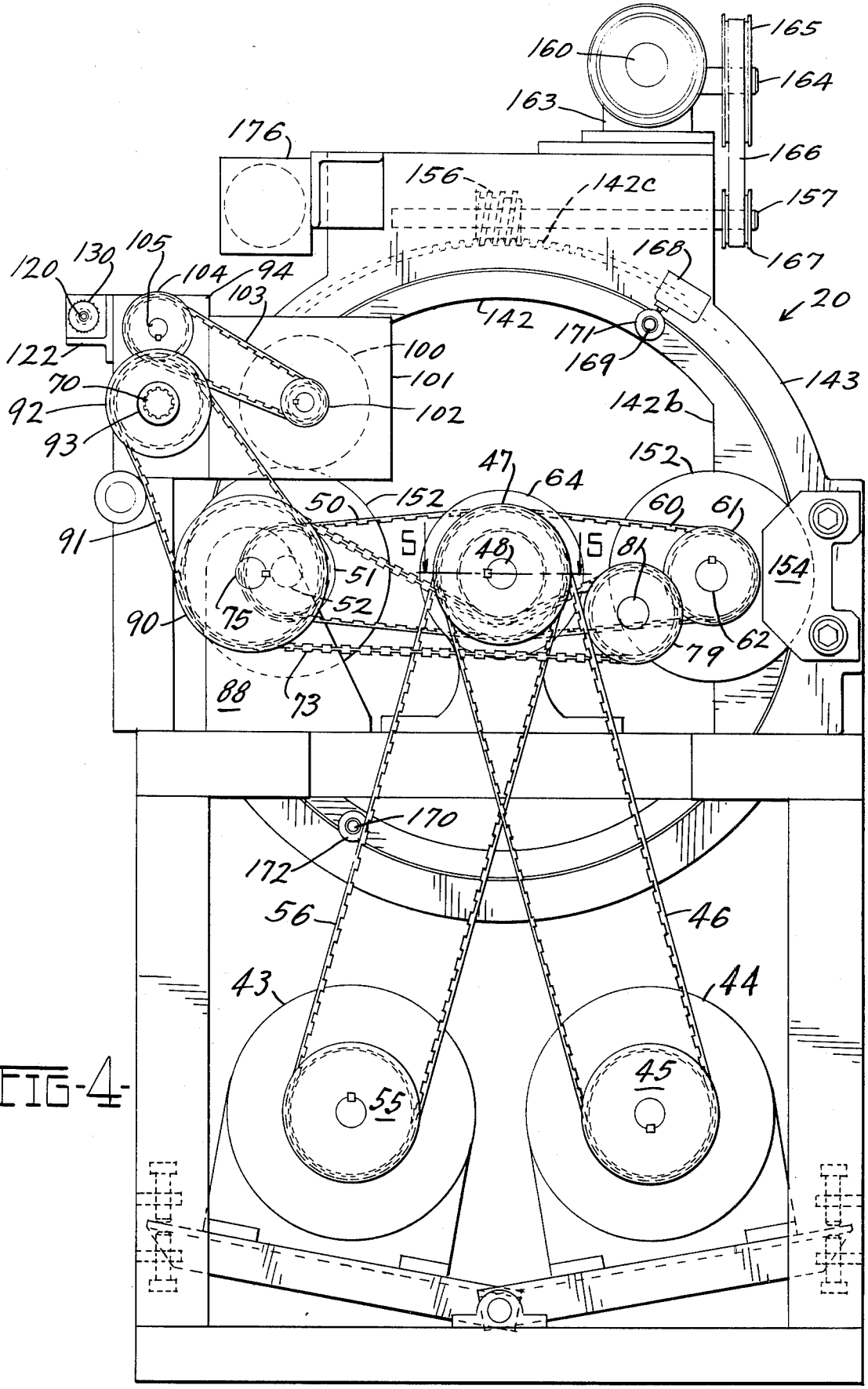
FIG. 4 is a rear view of the filament winding apparatus of FIG. 1 taken from the right-hand side of FIG. 3.
Figure 5:
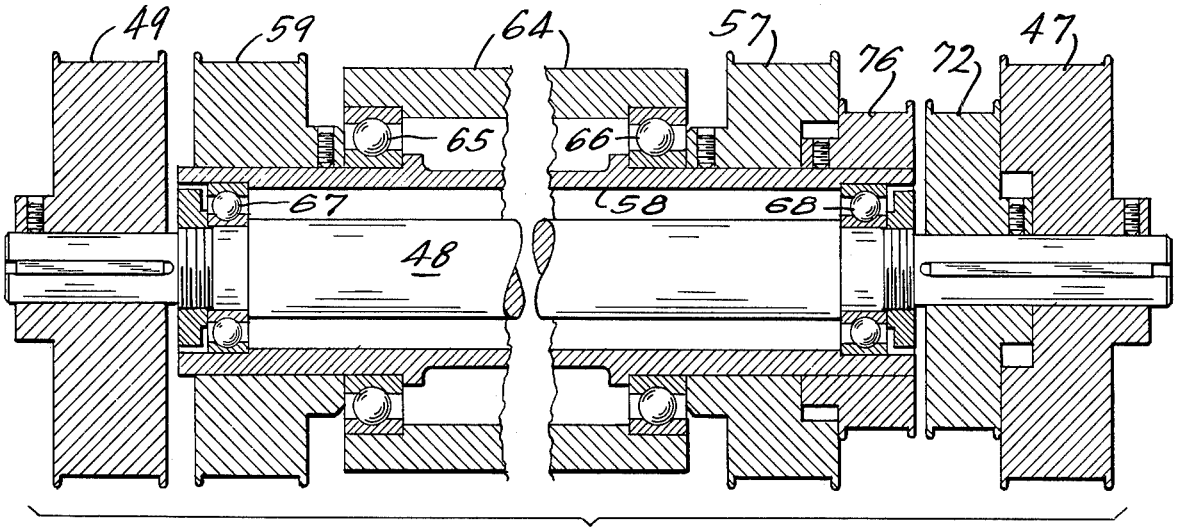
FIG. 5 is an enlarged horizontal sectional view of a pulley and drive shaft assembly of the winding apparatus of FIG. 1 taken generally along the line 5—5 of FIG. 4.

The pulleys 74 and 78 are concentric with the shaft 75, but annularly spaced therefrom, and are secured respectively to end faces of outer sleeves of a pair of commerically available one-way clutches 84 and 86 (FIG. 6) having inner sleeves secured to the shaft 75. The clutches are separated by an annular spacer 87. When the pulley 74 and the outer sleeve of the clutch 84 are rotated in one direction with respect to the inner sleeve of the clutch 84 and the shaft 75, slippage occurs, but when an attempt is made to rotate the pulley 74 and the outer sleeve of the clutch 84 in an opposite direction with respect to the inner sleeve of the clutch 84 and the shaft 75, internal mechanism of the clutch 84 locks the outer and inner sleeves together and the shaft 75 is rotably driven. The clutch 86 operates in the same manner. The shaft 75 is supported in a pair of ball bearings disposed respectively in slotted upper end portions of a pair of upstanding leg portions 88*a* and 88*b* of a suitably mounted generally U-shaped bracket 88 (FIG. 4). A grooved timing pulley 90 (FIGS. 3, 4, and 6) is keyed to the shaft 75 adjacent one end outside the bracket 88.

Figure 8:
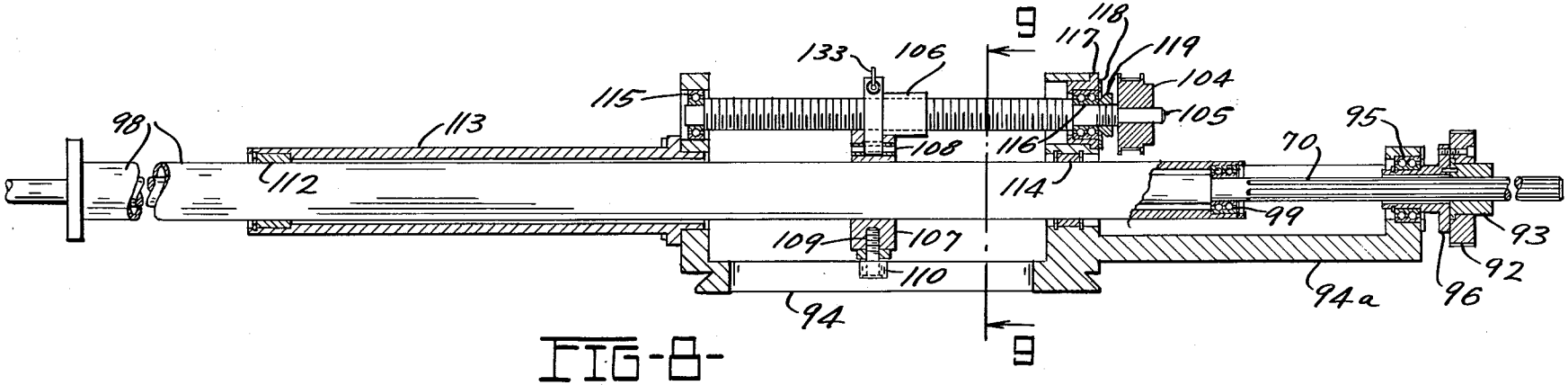
FIG. 8 is a vertical sectional view of an oscillator shaft assembly of the winding apparatus of FIG. 1 taken generally along the line 8—8 of FIG. 3, certain portions being omitted.
Figure 10:
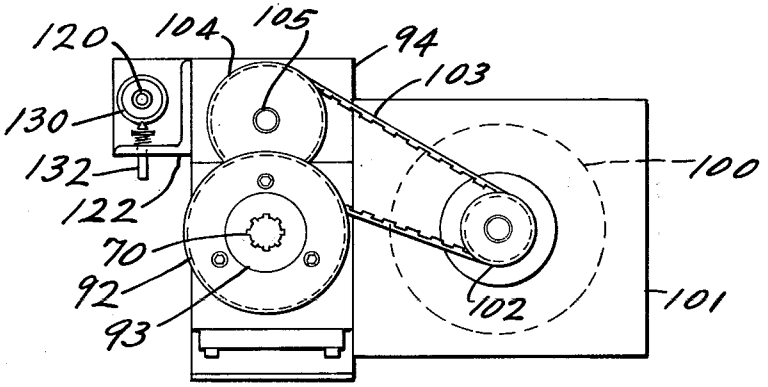
FIG. 10 is a rear view of oscillator shaft assembly taken from the right-hand side of FIG. 8.

The pulley 90 is connected by a toothed gear belt 91 to a grooved timing pulley 92 mounted as shown in FIGS. 8 and 10 to rotatably drive the strand oscillator shaft 70 while permitting it to reciprocate axially. The pulley 92 is mounted on a flanged bushing 93 made of a low friction material and having internal splines cooperatively engaged with external splines on a rear end portion of the shaft 70. A suitably mounted base casting 94 includes an arm 94*a* having a ball bearing 95 retained in a transverse end portion thereof. A flanged mounting sleeve 96 is retained in the inner race of the ball bearing 95. The pulley 92 is secured to the flange of the mounting sleeve 96 and is recessed to receive the flange of the bushing 93. The bushing 93 is rotatably tied to the sleeve 96 by dowel pins. Rotation of the pulley 92 thus drives the sleeve 96, the bushing 93, and the oscillator shaft 70.

A flanged reciprocable sleeve 98 concentric with the shaft 70 is provided adjacent its rear end with a ball bearing 99. An outer retaining ring recessed partially within an inner annular groove in the sleeve 98 retains an outer race of the bearing 99 against an internal shoulder on the sleeve 98, and an inner retaining ring recessed partially within an annular groove in the shaft 70 retains an inner race of the bearing 99 against a shoulder on the shaft 70. The sleeve 98 and the shaft 70 are thus tied together for reciprocation axially as a unit although the shaft 70 is rotatable while the sleeve 98 is not.

Figure 9:
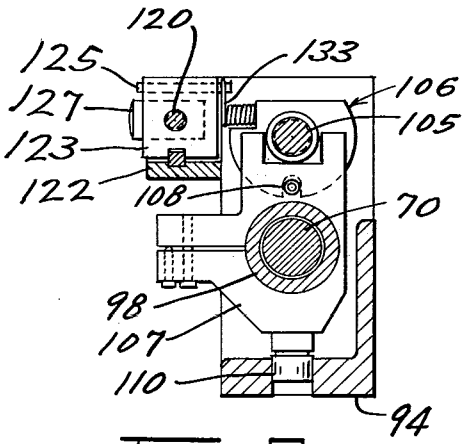
FIG. 9 is a vertical sectional view taken generally along the line 9—9 of FIG. 8.

A reversible electric motor 100 (FIG. 3) mounted on a bracket 101 secured to the casting 94 and having an output shaft extending through the bracket drives a grooved timing pulley 102 connected by a toothed gear belt 103 to a grooved timing pulley 104 keyed to a lead screw 105 having a flanged nut 106 threadedly mounted thereon. As best shown in FIGS. 8 and 9, the flange portion of the nut 106 is received within an upper groove in a clamp 107 secured to the sleeve 98 and is slotted to receive a pin 108 held in the clamp 107 for preventing rotation of the nut. A screw 109 is threaded into the bottom of the clamp 107 and provided on its head with a cam follower 110 disposed in a slot in the casting 94 to prevent rotation of the clamp 107. The sleeve 98 is reciprocable in a bushing 112 provided in a support sleeve 113 secured to the casting 94 and in a bushing 114 mounted in the casting 94. The lead screw 105 is rotatable in a ball bearing 115 mounted in the casting 94 and a ball bearing 116 mounted in a flanged bushing 117 provided in the casting 94. A retainer 118 secured to the bushing 117 holds the outer race of the bearing 116 against an internal shoulder of the bushing and a collar 119 threaded on the shaft 105 maintains the inner race of the bearing 116 against a shoulder on the shaft.

A normally stationary but rotatably adjustable screw 120 is mounted in a bracket 122 secured to the casting 94. Two insulating blocks 123 and 124 (FIG. 3) threadedly mounted on the screw 120 respectively hold a pair of electrical contact pins 125 and 126. Outwardly spring-biased depressible release plungers 127 and 128 provided respectively in the blocks 123 and 124 permit fast adjustment of the blocks axially of the screw 120, the blocks each having partial threads on one side of an oversized hole and the release plungers each providing the threads on the other side of the hole for engaging the screw 120. A toothed thumbwheel 130 on the shaft 120 permits simultaneous adjustment of the insulating blocks 123 and 124 axially of the shaft, a spring-biased, pointed plunger 132 (FIG. 10) mounted in the bracket 122 normally locking the thumbwheel in position and being pulled out of engagement therewith to permit rotation of the shaft 120 for adjustment of the blocks. The flange of the nut 106 carries a spring 133 having an end portion engageable alternately with the contact pins 125 and 126 to reverse the motor 100 and reciprocate the sleeve 98.

Pairs 135 and 136 (FIG. 2) of strand oscillating members are provided on a front end portion of the strand oscillator shaft 70. The pairs of strand oscillating members are formed of wire and shaped in accordance with those described in U.S. Pat. No. 2,391,870 issued Jan. 1, 1946, to George Beach. Rapid rotation of the shaft 70 causes the strand oscillating members to oscillate the strands 27 and 28 axially of the collet 33 or 34 in the winding position, while reciprocation of the shaft 70 by the sleeve 98 occurs slowly in the forming of a strand package. Support means is provided for the front end portion of the shaft 70, this support means being in the form of a pair of arms 137 and 138 connected by a sleeve 140, the arm 138 being secured to the flange of the sleeve 98. Preferably the shaft 70 is formed in two parts coupled together and supported in bearings at the flange of the sleeve 98.

The turret 32 includes a hollow cylindrical body 142 (FIG. 7) rotatably mounted in a suitably supported housing 143 and maintained against a lower rear internal flange portion 143*a* thereof by an upper front thrust bearing plate 144 secured to the housing 143. The body 142 includes a plurality of front bosses 142*a* to which a front turret cover 145 flush with the panel 42 is suitably secured. The cover 145 carries a pair of flanged, generally tubular shields 147 and 148 respectively for the collets 33 and 34. The turret body 142 includes a pair of diametrically opposite, interior, thickened mounting pad portions, one of which is shown in FIG. 4 and indicated by numeral 142*b*. Each of the mounting pad portions such as portion 142*b* is provided with a semi-cylindrical recess and has a pair of clamps 150 (FIG. 7), also provided with semi-cylindrical recesses, secured thereto for rotatably supporting an enlarged portion of the respective collet shaft, such as the portion 62*a* of the shaft 62 of collet 33. Each of the collet shafts 52 and 62 has a brake disk 152 secured thereto by means of a clamping hub 153. Pneumatically operable caliper brake means 154 (FIG. 3) is mounted on the turret housing 143 for cooperative braking engagement with the disks 152 for stopping rotation respectively of the collets 33 and 34 when they are in the strand package unloading position.

Figure 7:
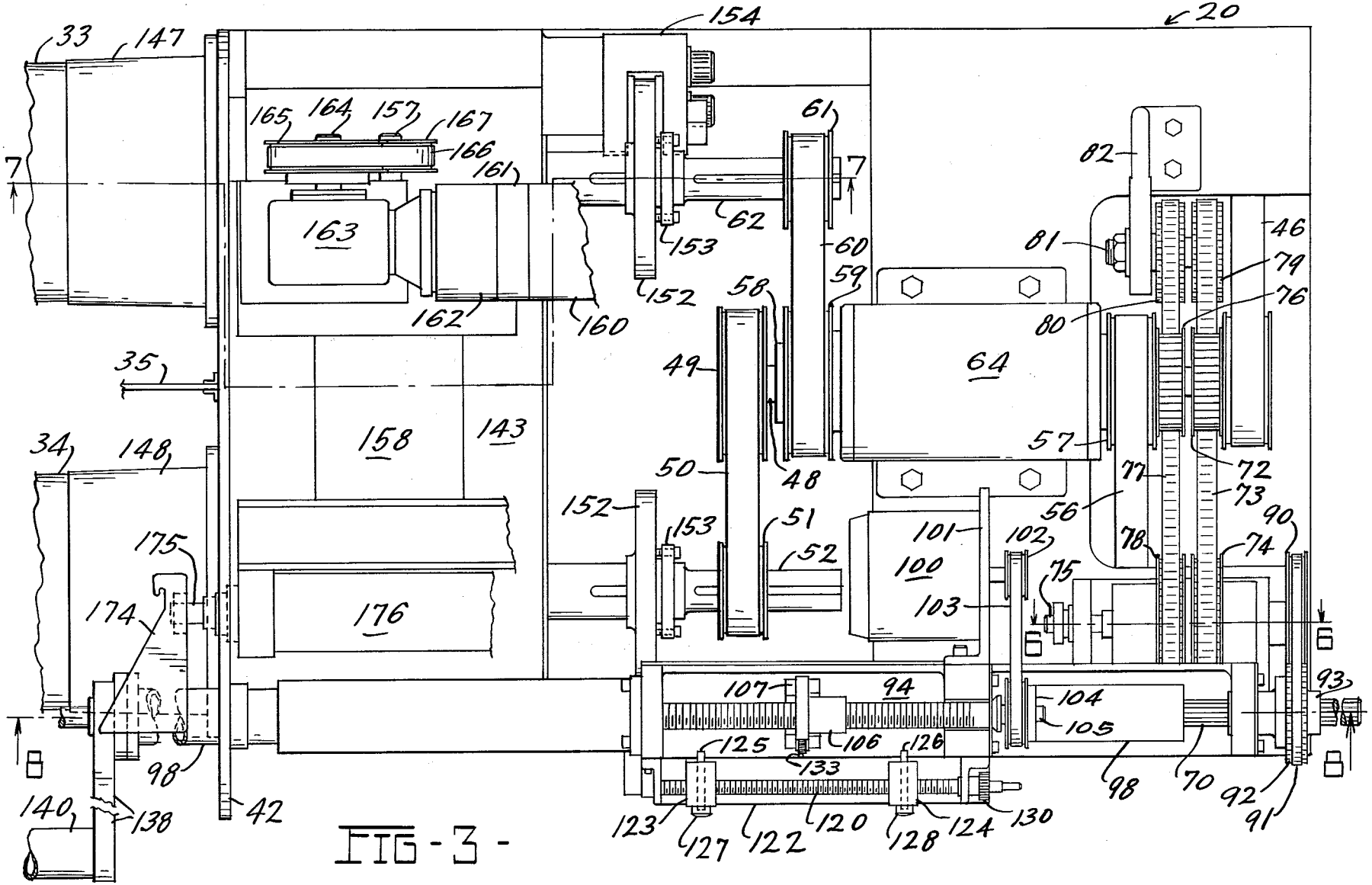
FIG. 7 is a fragmentary vertical sectional view of a collet indexing turret of the winding apparatus of FIG. 1 taken generally along the bent section line 7—7 of FIG. 3.

The turret body 142 is periodically indexed through half a revolution by a worm gear mechanism including a worm 156 (FIGS. 4 and 7). The worm 156 is mounted on a shaft 157 mounted in suitable bearings (not shown) in a worm shaft housing 158 recessed within an upper portion of the turret housing 143. The turret body 142 is also a worm gear by virtue of gear teeth 142*c* formed in the outer periphery thereof for cooperation with the worm 156. The shaft 157 and worm 156 are driven by an electric motor 160 assembled with clutch mechanism 161 and brake mechanism 162 and acting through gear reducing mechanism 163 mounted on the turret housing 143 and having an output shaft 164. A grooved timing pulley 165 keyed to the shaft 164 is connected by a toothed gear belt 166 to a grooved timing pulley 167 keyed to the shaft 157. A limit switch 168 mounted on the turret housing 143 is alternately operable by a pair of pins 169 and 170 threaded into a rear interior flange portion 142*d* of the turret body 142 at diametrically opposite portions thereof and respectively having switch operating collars 171 and 172 on the exterior ends thereof. Operation of the limit switch 168 by either of the collars 171 and 172 interrupts the power to the motor 160, disengages the clutch mechanism 161, and engages the brake mechanism 162 to stop rotation of the turret body 142 substantially instantaneously after the indexing thereof through half a revolution.

A strand hold-off plate 174 (FIG. 3) of the hold-off means 38 is mounted on a piston rod 175 of a pneumatic actuator 176 mounted on the turret housing 143.

Figures 11, 12:
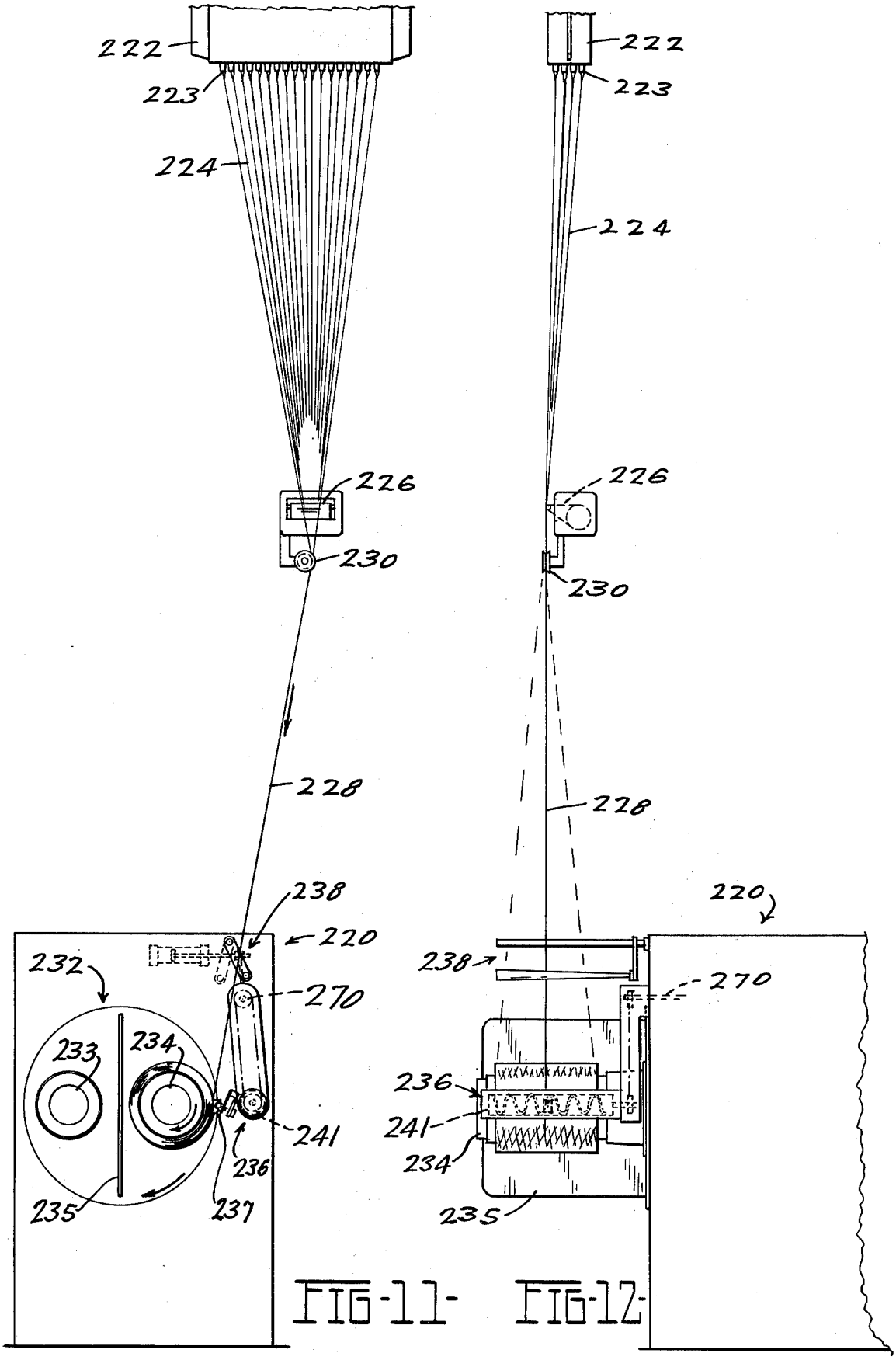
FIGS. 11 and 12 are views similar respectively to FIGS. 1 and 2, but illustrating another embodiment of a filament winding appartus constructed in accordance with the invention.

FIGS. 11 and 12 illustrate another filament winding apparatus 220 constructed in accordance with the invention for pulling filaments 224 from tips 223 of a bushing 222 over a sizing applicator belt 226 and a gathering pulley 230 and winding a strand 228 of filaments into a package. The apparatus 220 includes a turret 232 periodically indexible through half a revolution and having a pair of winding collets 233 and 234 rotatably mounted thereon and separated by a shield 235. A strand oscillator 236 substantially identical to that described in U.S. Pat. No. 3,838,827, issued Oct. 1, 1974, to Jerome P. Klink et al., and strand hold-off means 238 are provided. The strand oscillator 236 includes a strand traverse guide 237 reciprocable axially of the winding collet 234 by rotation of a barrel cam 241 driven by a rotatable shaft 270. The shaft 270 is rotatably driven by means similar to the driving means

OPERATION

Assuming that the motor 44 is driving the collet 34 through pulley 45, belt 46, pulley 47, shaft 48, pulley 49, belt 50, pulley 51, and shaft 52, and is driving the strand oscillator shaft 70 through pulley 45, belt 46 pulley 47, shaft 48, pulley 72, belt 73, pulley 74, clutch 84, shaft 75, pulley 90, belt 91, pulley 92, and bushing 93, that the motor 100 is reciprocating the shaft 70 through pulley 102, belt 103, pulley 104, shaft 105, nut 106, clamp 107, and sleeve 98, that the collet 33 is being held by the brake means 154 and the brake disk 152 on the shaft 62, that the strand packages on the collet 34 are nearly finished being wound, that previously wound strand packages have been removed from the collet 33, and that empty paper sleeves have been installed on collet 33, the brake means 154 is released and motor 43 is started to drive the collet 33 through pulley 55, belt 56, pulley 57, shaft 58, pulley 59, belt 60, pulley 61, and shaft 62, and bring the collet 33 up to the minimum speed at which collet 34 is operating for winding of the end of a strand package at the final outer diameter. The motor 43 also drives the clutch 86 through pulley 55, belt 56, pulley 57, shaft 58, pulley 76, belt 77, and pulley 78. Power to motor 44 is then interrupted, collet 34 starts to slow down along with the clutch 84, clutch 86 takes over the rotational driving of the oscillator shaft 70 through shaft 75, pulley 90, belt 91, pulley 92, and bushing 93, the strand hold-off plate 174 is extended, the turret indexing motor 160 is started, the brake 162 is released, and the clutch 161 is engaged to index the turret body 142 through shaft 164, pulley 165, belt 166, pulley 167, shaft 157, and worm 156. The collet 33 is brought up to the maximum speed, for winding the beginning of a strand package at the minimum diameter, during indexing of the turret body 142. As collet 33 comes into final position for winding, collar 172 on the pin 170 operates the limit switch 168 to interrupt power to the motor 160, engage the brake 162, and release the clutch 161, ending the indexing of the turret body 142 through half a revolution. The strand hold-off plate is then retracted and strand winding starts on the paper sleeves on the collet 33.

The use of a worm and worm gear mechanism to index the collet-carrying turret, along with the clutch 161 and brake 162 controlled by the limit switch 168, results in accurate positioning of the collet in the winding station with respect to the strand oscillator shaft 70 after each indexing movement. Further, the use of the two one-way clutches 84 and 86 on a single shaft to drive the oscillator shaft 70 results in the rotational speed of the oscillator shaft 70 always being keyed to the speed of the collet in the winding station.

A proper winding pattern repeatable in package after package of wound strand is thereby provided, even though the speed of the collet at the winding station is progressively reduced as the diameter of the strand package being wound increases in order to maintain the diameter of the filaments being formed substantially constant, and even though the winding switches from one collet to another upon indexing of the turret. The collet in the winding station is always accurately positioned with respect to the strand oscillator shaft after each indexing movement, and the rotational speed of the strand oscillator shaft is always in the same ratio to the speed of the faster revolving collet.

Various modifications may be made in the structure shown and described without departing from the spirit and scope of the invention.

We claim:

1. Filament winding apparatus comprising a turret body mounted for rotation about a horizontal axis, means for periodically indexing the turret body, a pair of strand winding collets mounted on the turret body and respectively including a pair of winding collet shafts extending through the turret body for rotation respectively about axes parallel to and equal distances from the axis of rotation of the turret body, a pair of rotatably driven members mounted respectively on the winding collet shafts on the opposite side of the turret body from the winding collets, a first shaft spaced from the turret body axially thereof and mounted for rotation about an axis coaxial with the axis of rotation of the turret body, a hollow second shaft mounted concentrically of the first shaft for rotation independently thereof, the first shaft being longer than the second shaft and projecting outwardly from opposite ends thereof, a first pair of rotatable driving members mounted respectively on first end portions of the first and second shafts, means respectively operatively connecting the first pair of rotatable driving members on the first end portions of the first and second shafts with the rotatably driven members on the winding collet shafts, a pair of variable speed motors respectively including a pair of motor shafts, a pair of rotatable driving members mounted respectively on the motor shafts, a pair of rotatably driven members mounted respectively on second end portions of the first and second shafts, means respectively operatively connecting the rotatable driving members on the motor shafts with the rotatably driven members on the second end portions of the first and second shafts, a second pair of rotatable driving members mounted respectively on the second end portions of the first and second shafts, a strand oscillator shaft transversely spaced from the turret body and mounted for rotation about an axis parallel to the axis of rotation of the turret body, a rotatably driven member mounted on the strand oscillator shaft, a clutch shaft spaced from and parallel to the strand oscillator shaft, a pair of one-way clutches mounted on the clutch shaft independently of each other, a rotatable driving member mounted on the clutch shaft, means respectively operatively connecting the second pair of rotatable driving members on the second end portions of the first and second shafts with the clutches on the clutch shaft, and means operatively connecting the rotatable driving member on the clutch shaft with the rotatably driven member on the strand oscillator shaft.

2. Filament winding apparatus as claimed in claim 1, including means for axially reciprocating the strand oscillator shaft.

3. Filament winding apparatus as claimed in claim 1 including an idler pulley shaft transversely spaced from and parallel to the first and second shafts on the opposite side thereof from the clutch shaft and a pair of rotatably driven idler members rotatably mounted on the idler pulley shaft independently of each other, the means respectively operatively connecting the second pair of rotatable driving members on the second end portions of the first and second shafts with the clutches being a pair of endless belts looped respectively around the clutches and the rotatably driven idler members with both upper and lower portions of the belts being respectively on one side of the second pair of rotatable driving members.

* * * * *